United States Patent [19]

Martin

[11] 4,107,972

[45] Aug. 22, 1978

[54] DIES FOR FORGING AND TREPANNING LARGE DIAMETER COUPLINGS AND METHOD OF FORGING AND TREPANNING COUPLINGS

[75] Inventor: Wayne A. Martin, Wilkens Township, Allegheny County, Pa.

[73] Assignee: United States Steel Corporation, Pittsburgh, Pa.

[21] Appl. No.: 849,153

[22] Filed: Nov. 7, 1977

[51] Int. Cl.[2] ..... B21D 28/00

[52] U.S. Cl. ..... 72/334; 72/338; 72/356; 72/370

[58] Field of Search ..... 72/327, 334, 333, 338, 72/343, 367, 368, 370, 356

[56] References Cited

U.S. PATENT DOCUMENTS

| | | | |
|---|---|---|---|
| 783,889 | 2/1905 | Perkins et al. | 72/356 X |
| 1,171,344 | 2/1916 | Legere | 72/267 X |
| 2,348,179 | 5/1944 | Moore | 72/327 |
| 2,369,299 | 2/1945 | Kafowi | 72/343 |

*Primary Examiner*—Leon Gilden
*Attorney, Agent, or Firm*—Walter P. Wood

[57] ABSTRACT

A die and cooperating parts for forging and trepanning large diameter couplings and a method of forging and trepanning such couplings. A single die is used with a series of cooperating inserts and a riser in performing all the various steps necessary to forge and trepan the coupling. The same die and riser with appropriate inserts also can be used in forging and trepanning couplings of a range of sizes.

12 Claims, 7 Drawing Figures

DIES FOR FORGING AND TREPANNING LARGE DIAMETER COUPLINGS AND METHOD OF FORGING AND TREPANNING COUPLINGS

This invention relates to improved dies and cooperating parts for forging and trepanning large-diameter high-quality couplings, and to an improved method of forging and trepanning such couplings.

The die and method are most useful in forming couplings which have a body of a diameter up to about five feet and a flange at one end of the body of a diameter up to about six feet. Such couplings are used, for example, in electrical power plants for connecting a drive shaft with a driven shaft, and must be precisely dimensioned within narrow tolerances, as well as having uniform properties and being of sonic quality. To minimize machining of the forged coupling to its final dimensions, the dimensions of the forging should be as close as possible to the final dimensions.

An object of the present invention is to provide an improved die and cooperating parts which enable a single die to be used with appropriate inserts and riser in performing all steps of forging and trepanning a large diameter coupling.

A further object is to provide an improved die and cooperating parts which enable the same die and riser to be used in forging and trepanning couplings of a range of sizes.

A further object is to provide an improved forging and trepanning method in which the same die is used with different inserts and a riser as the different steps of the operation are performed, whereby the same die is used throughout the operation.

Figure 1:
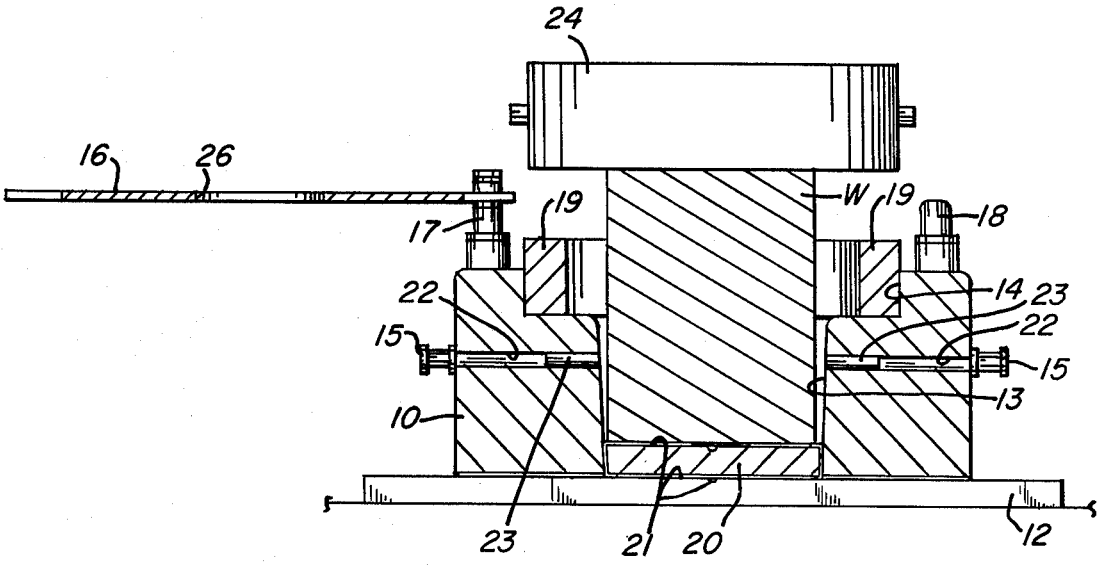
FIG. 1 is a vertical sectional view of a die, inserts, and workpiece showing the first step in a forging operation in accordance with the present invention.

FIG. 1 shows an annular die 10 of my invention. The die includes an annular body which rests on a removable base plate 12 and has a bore 13 and counterbore 14. The outer face of the die body has lifting lugs 15. A trepan guide 16 is pivoted to a pin 17 upstanding from the upper face of the die, and may be latched on a diametrically opposed pin 18. The trepan guide is described in more detail hereinafter. An annular coupling flange die insert 19 is removably received in the counterbore 14. Different size inserts can be used to vary the flange diameter, but the inside diameter of the insert normally is larger than the inside diameter of the bore 13. A flat circular bottom die spacer 20 is removably received in the bore 13 and rests on the base 12. Preferably the spacer 20 has vent passages 21 in upper and side faces. Spacers of different thickness may be used to vary the length of the coupling. Preferably the die 10 has holes 22 drilled along a diameter for a purpose hereinafter explained. In FIG. 1 plugs 23, which have a slight taper, are shown inserted in holes 22 from the inside. A cylindrical workpiece W, heated to a suitable forging temperature, is placed within the bore 13 and rests on the spacer 20. A stoving plate 24 overlies the workpiece.

Figure 2:
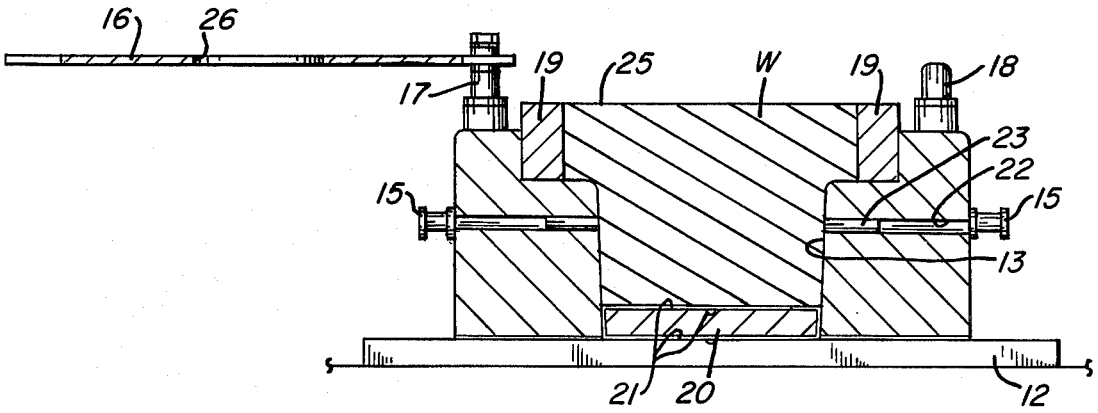
FIG. 2 is a similar view showing the second step.

FIG. 2 shows the second step of the operation. The workpiece W has been subjected to forces which upset it and contour-forge it to the outside configuration of a coupling which conforms with the space defined by the bore 13 of the die 10 and the inner circumference of the insert 19. The portion of the workpiece within the insert 19 forms an annular flange 25. The plugs 23 provide a smooth internal surface for the die at the holes 22.

Figure 3:
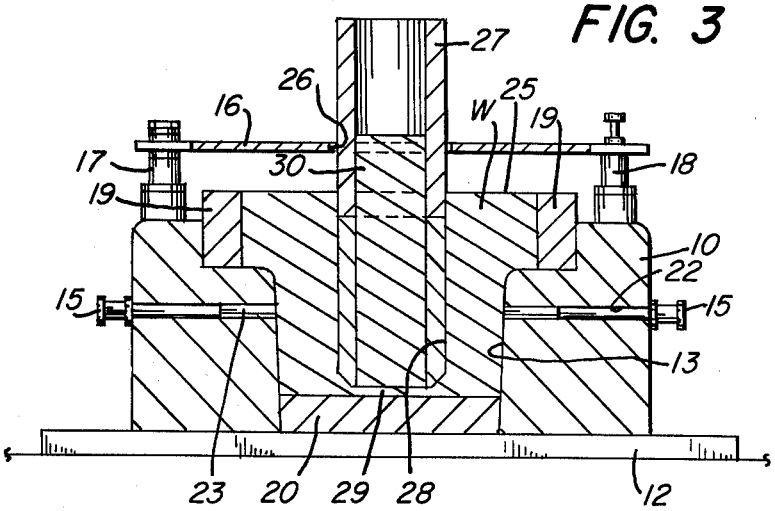
FIG. 3 is another similar view, but showing in addition a trepanning tool used in the third step.

FIG. 3 shows the third step of the forging operation. The stoving plate 24 has been removed and the trepan guide 16 swung around to overlie the workpiece W with its free end anchored on pin 18. The guide should be spaced above the upper face of the workpiece by at least four or five inches to permit clearance if the workpiece moves upwardly during the fourth step of the operation hereinafter described. The guide has a central opening 26 concentric with the workpiece 21. A conventional trepan tool 27 is forced downwardly through the central opening of the guide and trepans a hole 28 in the workpiece almost to the bottom face, leaving a thin wall 29 at the bottom of the hole. The core removed from the workpiece is indicated at 30.

Figure 4:
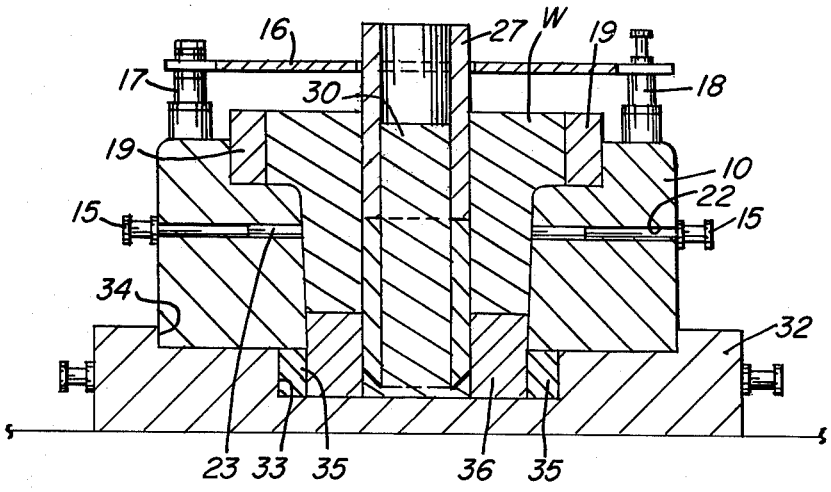
FIG. 4 is another similar view, but showing a riser and inserts used in the fourth step.

FIG. 4 shows the fourth step of the operation. At the conclusion of the third step, the die 10, workpiece W and trepan tool 27 are lifted with the tool and core remaining in place in the workpiece. The base 12 and spacer 20 are pushed away. A riser 32 is pushed under the lifted die. The riser has a recess 33 and a counter recess 34. An annular riser filler plate 35 is removably inserted in the recess 33, and an annular trepan clearance insert 36 in the plate 35 before the riser is pushed under the die. When the die is lowered, it fits within the counter recess 34 of the riser and the workpiece W contacts the upper face of the trepan clearance insert 36. The trepan tool 27 is forced downwardly through the thin wall 29, thus completing the trepanning step. As the tool is forced downwardly, the workpiece tends to move upwardly a few inches. Hence it is desirable to provide a clearance of several inches between the top of the workpiece and the trepan guide 16 to avoid contact. Slight upward movement of the workpiece aids in removing the workpiece from the die at the completion of the operation.

Figure 5:
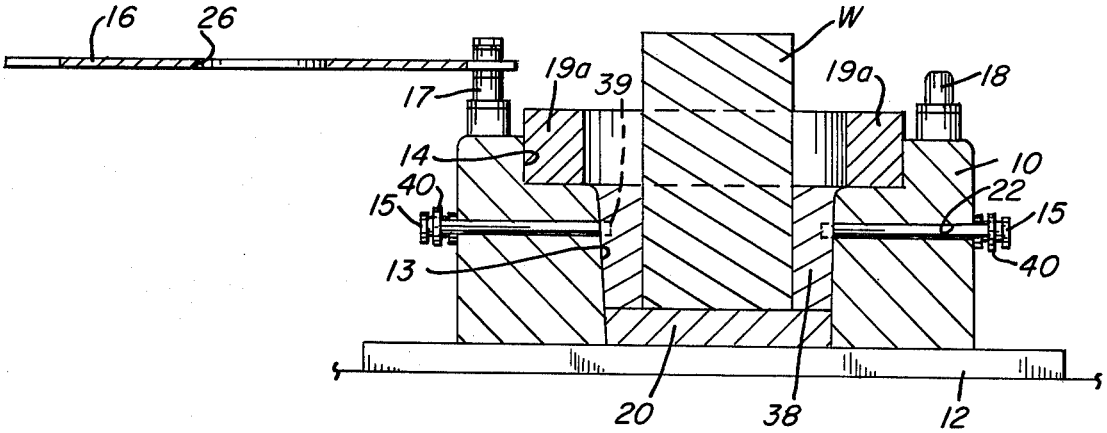
FIG. 5 is a view similar to FIG. 1, but showing how the die may be used in forging a coupling of smaller diameter.

FIG. 5 shows the way in which the die 10 is used in forging couplings of a diameter smaller than the diameter of the bore 13. An annular adapter insert 38 is placed within the bore, and a workpiece W of smaller diameter placed within the adapter insert. A flange insert **19*a* of smaller inside diameter than the insert 19 is placed within the counterbore 14. The insert 38 has sockets 39 aligned with holes 22. The plugs 23 are removed from these holes and replaced with rods 40 which extend into sockets 39. Thus the rods hold the insert 38 within the die 10** when the forged workpiece is removed from the die.

Figure 6:
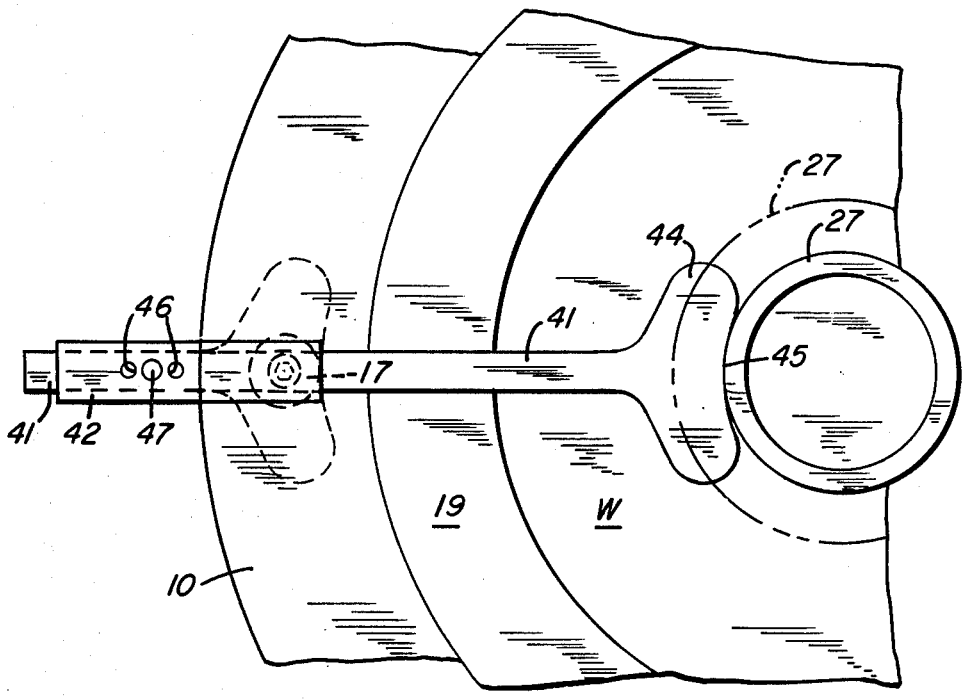
FIG. 6 is a top plan view of an alternative form of trepan guide.
Figure 7:
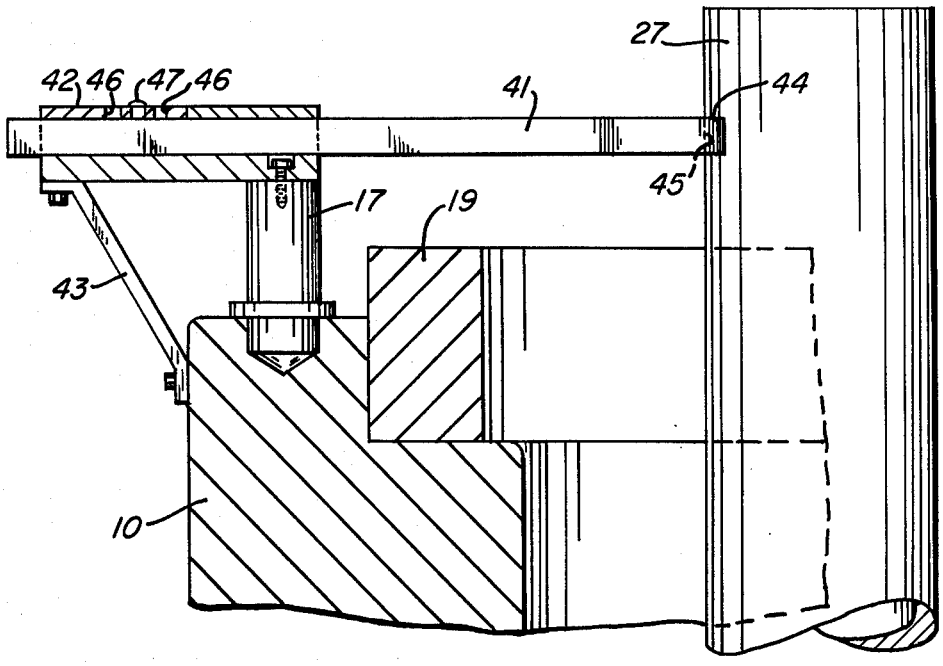
FIG. 7 is a side elevational view of the guide shown in FIG. 6.

FIGS. 6 and 7 show a trepan guide of a modified construction. The modified guide includes a bar 41 which is mounted in a slideway 42. The slideway is attached to the top of pin 17, but held against rotation by braces 43. The bar has a guide head 44 which has an arcuate edge 45 of a radius equal to the radius of the largest trepan tool 27 expected to be used. Except at the start of a trepanning step, bar 41 is retracted to a position clear of the workpiece W. At the beginning of a trepanning operation the bar is advanced to a position in which the arcuate edge 45 can contact the tool and guide it as it starts to form a hole in the workpiece. If the tool is smaller than the maximum size, the arcuate edge still is effective for guiding it. Conveniently the top of the slideway 42 has holes 46 spaced to position the bar for the sizes of trepan tool commonly encountered. A pin 47 is inserted in the appropriate hole 46 and in a corresponding hole in the bar 41 to position the bar. Since the bar is retracted during the fourth step, there is no problem of the workpiece contacting the bar if it moves upwardly.

During a forging operation the die and its cooperating parts are heated by contact with the hot workpiece. Hence the parts are dimensioned to allow for expansion and have a slip fit. For example, parts which are placed within the bore 13 and counterbore 14 of the die 10 may have an outside diameter about an inch less than the inside diameter of the bore and counterbore.

From the foregoing description it is seen that the invention affords a die and cooperating parts which enable a single die to be used in performing all steps necessary to forge and trepan a large size coupling. The action of forcing the metal into the space within flange insert is effective in producing excellent flow lines in the finished coupling. Trepanning the workpiece while it is still hot and within the die holds outside dimensions of the coupling and further reduces the amount of material which must be removed by machining. The die is readily adapted for forming couplings or similar type products of a range of sizes.

I claim:

1. For forging a large diameter coupling, a die including a body having a bore and a counterbore, an annular flange insert received in said counterbore and having an inside diameter larger than the diameter of said bore, and a flat circular spacer received in said bore, said bore and said flange insert being adapted to receive a heated cylindrical workpiece which rests on said spacer, said bore, flange insert and spacer defining a space for contour-forging the workpiece to the outside configuration of a coupling having a flange at one end, said insert and spacer being removable and replaceable with inserts of different size.

2. A die as defined in claim 1 including a trepan guide mounted on the upper face of said body and having means for guiding a trepan tool to punch a concentric hole through a workpiece, said guide being movable to a position clear of the workpiece.

3. A die as defined in claim 2 in which said guide is pivotally mounted and clears the workpiece sufficiently to permit the workpiece to move upwardly while the trepan tool punches a hole through the workpiece.

4. A die as defined in claim 2 in which said guide is slidably mounted to be moved clear of the workpiece after a hole has been started.

5. In combination, a die and cooperating parts for forging and trepanning a large diameter coupling;

said die including a body having a bore and a counterbore;

said parts including:

an annular flange insert removably received in said counterbore and having an inside diameter larger than said bore; and a flat circular spacer removably received in said bore;

said bore and said flange insert being adapted to receive a heated cylindrical workpiece for contour forging to the outside configuration of a coupling having a flange at one end;

said parts further including:

a trepan guide mounted on the upper face of said body and having means for guiding a trepan tool to punch a concentric hole through the workpiece;

a riser for receiving said body while the hole is completed, said spacer being removed; and a filler plate and trepan clearance insert received in said riser.

6. A combination as defined in claim 5 in which said spacer has at least one vent passage.

7. A combination as defined in claim 5 in which said parts further include an adapter insert received in said bore for forging couplings of a diameter smaller than the bore diameter.

8. A combination as defined in claim 7 in which said die has holes and said adapter has sockets aligned with said holes, and comprising rods inserted in said holes and sockets.

9. A combination as defined in claim 5 in which said guide is pivoted to the upper face of said body.

10. A combination as defined in claim 5 further comprising a slideway mounted on the upper face of said body, said guide being slidably mounted in said slideway and having a head providing an arcuate edge of a radius at least as great as the radius of the trepan tool.

11. A method of forging and trepanning a large diameter coupling, said method comprising:

contour-forging a heated workpiece to the outside configuration of a coupling having a flange at one end in a die which has a bore and a counterbore, the counterbore containing an annular flange insert;

trepanning a hole almost through the workpiece with a trepan tool guided by said guide, leaving a thin wall of the material at the bottom of the hole;

placing said die, workpiece and tool on a riser; and trepanning the hole completely through the workpiece;

the same die being used in performing all the forging steps.

12. A method as defined in claim 11 in which said workpiece moves upwardly as the hole is trepanned completely therethrough, but contact is avoided between the workpiece and guide, the upward movement of the workpiece aiding in subsequent removal of the workpiece from the die.

* * * * *